US007832307B2

(12) United States Patent
Ferrari

(10) Patent No.: US 7,832,307 B2
(45) Date of Patent: Nov. 16, 2010

(54) CORKSCREW

(75) Inventor: Ruggero Ferrari, Parma (IT)

(73) Assignee: Marisa Marchignoli, Parma (IT)

( * ) Notice: Subject to any disclaimer, the term of this patent is extended or adjusted under 35 U.S.C. 154(b) by 13 days.

(21) Appl. No.: 11/920,291

(22) PCT Filed: May 24, 2005

(86) PCT No.: PCT/EP2005/005583

§ 371 (c)(1),
(2), (4) Date: Nov. 13, 2007

(87) PCT Pub. No.: WO2006/125455

PCT Pub. Date: Nov. 30, 2006

(65) Prior Publication Data

US 2009/0044344 A1 Feb. 19, 2009

(51) Int. Cl.
*B67B 7/04* (2006.01)

(52) U.S. Cl. ..... 81/3.45; 81/3.33; 81/3.37; 81/3.29

(58) Field of Classification Search ..... 81/3.45, 81/3.33, 3.36, 3.37, 3.29, 3.47, 3.48
See application file for complete search history.

(56) References Cited

U.S. PATENT DOCUMENTS 814,641 A * 3/1906 Coomber ..... 81/3.33
5,934,160 A * 8/1999 Gibson ..... 81/3.37
6,016,721 A * 1/2000 Braun ..... 81/3.29
6,073,519 A * 6/2000 Presa Eguren ..... 81/3.33
6,401,569 B2 * 6/2002 Usbeck ..... 81/3.36
6,546,831 B2 * 4/2003 So ..... 81/3.48
6,622,330 B2 * 9/2003 Puig ..... 7/155
6,622,595 B1 * 9/2003 Federighi ..... 81/3.48
7,398,709 B2 * 7/2008 Vitrac et al. ..... 81/3.37
2002/0174489 A1 11/2002 Puig
2007/0289411 A1 * 12/2007 Olaneta Arambarri ..... 81/3.47

FOREIGN PATENT DOCUMENTS

WO WO 00/17087 3/2000

OTHER PUBLICATIONS

International Search Report; Jan. 26, 2006, PCT/EP2005/005583.

* cited by examiner

*Primary Examiner*—D. S Meislin
(74) *Attorney, Agent, or Firm*—Hedman & Costigan, P.C.; James V. Costigan

(57) ABSTRACT

The invention is a corkscrew (1) for caps made of cork or plastics equipped with two levers (7) and (8) each having two shaped or cam outlines (11, 12) that subject corresponding teeth (41) and (51), carried by concentric barrels (4) and (5), to different movements such as to allow the complete extraction of the cap from the bottle and its ejection. The corkscrew (1) takes care of blocking the bottle neck during the worm screwing through a garter-spring tightening arrangement (6). The levers (7,8) are synchronously moved through teeth (13) that engage a toothed wheel (14).

4 Claims, 4 Drawing Sheets

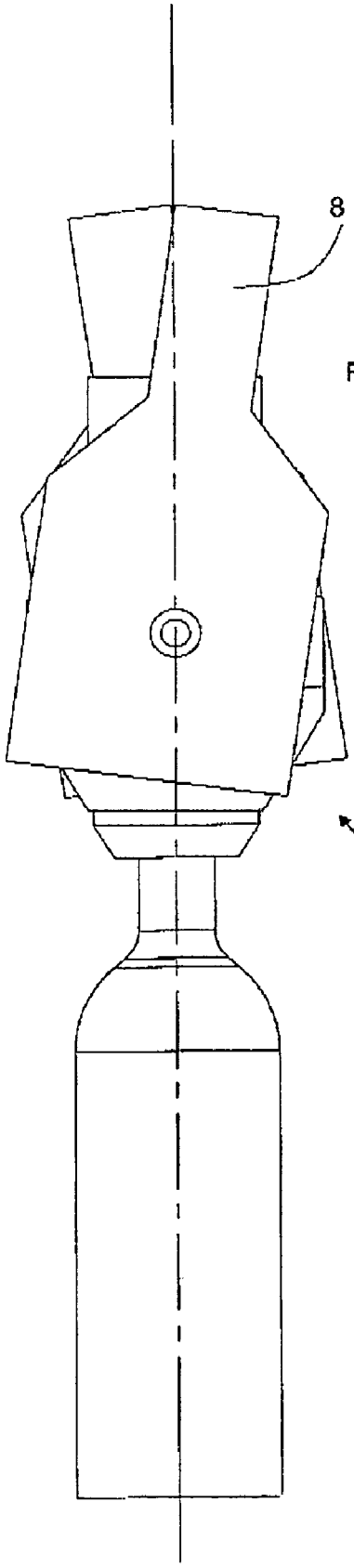
FIG. 3
FIG. 4
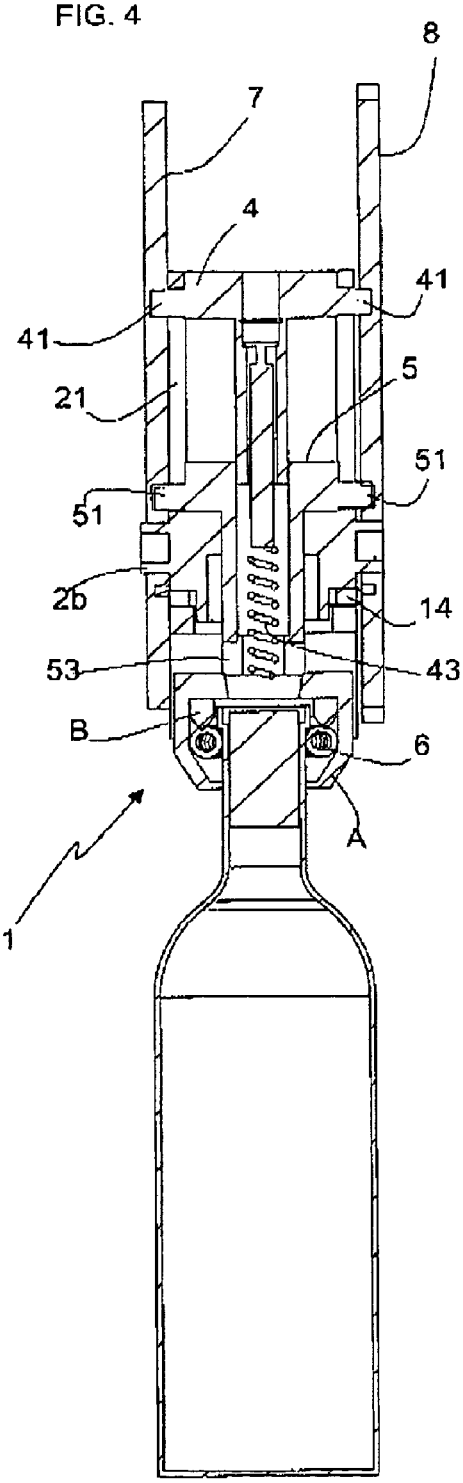

CORKSCREW

CROSS-REFERENCE TO RELATED APPLICATIONS

Not Applicable

STATEMENT REGARDING FEDERALLY SPONSORED RESEARCH OR DEVELOPMENT

Not Applicable

INCORPORATION-BY-REFERENCE OP MATERIAL SUBMITTED ON A COMPACT DISK

Not Applicable

REFERENCE TO A MICROFICHE APPENDIX

Not Applicable

BACKGROUND OF THE INVENTION

Field of the Invention

This invention is concerned with a novel corkscrew that removes a cork from a bottle.

BRIEF SUMMARY OF THE INVENTION

The present invention is concerned with a corkscrew having cams and is different from all other corkscrews due to the following mode of operation: with only two levers and only two movements, the corkscrew screws the worm into the cork, extracts it from the bottle and expels the cork from the worm, in an ergonomic and simple way.

The two levers, during their cycle, control two suitably and mutually configured cams, which generate a mutual reciprocating movement along their path. This movement on one hand screws and extracts the cork, and an the other hand ejects the cork without any manual support and/or additional intervention.

It is an object of the present invention to provide a corkscrew that, through two levers and a suitable combination of shaped outlines, allows extracting a cork from a bottle.

Another object is to allow the cork, to be automatically detached from the corkscrew.

These objects and advantages are all achieved by the cam corkscrew of the present invention, that is characterised by a central body (2) and a base (3) joined thereto; the central body (2) having two plane and parallel surfaces (2*a*) each one of which has a pin (2*b*) that allows a coupling with levers (7, 8), characterised in that said levers (7, 8) have shaped or cam outlines (11, 12), each one of which is respectively put in contact with teeth (41, 51) projecting from a pair of concentric barrels (4) and (5) which arte inserted in the central body (2); the shaped outlines (11, 12) allow extracting and ejecting the cork.

These and other characteristics will be better understood from the following description of some embodiments that are provided merely as a non-limiting examples.

BRIEF DESCRIPTION OF THE SEVERAL VIEWS OF THE DRAWINGS

FIG. 3 is a side view of the corkscrew of the invention.

FIG. 4 is a cross-section of the corkscrew of the invention facing the front of the corkscrew.

Figure 1:
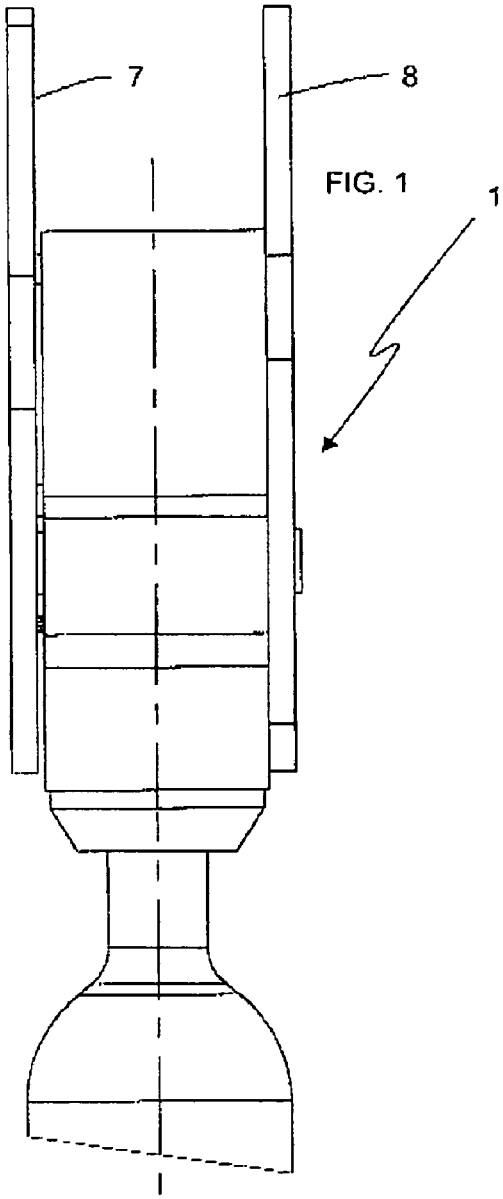
FIG. 1 is a front view of the corkscrew of the invention.

DETAILED DESCRIPTION OF THE INVENTION with reference to FIG. 1, 1 designates a cam corkscrew that is essentially composed of a central body 2 and a base 3.

Figure 2:
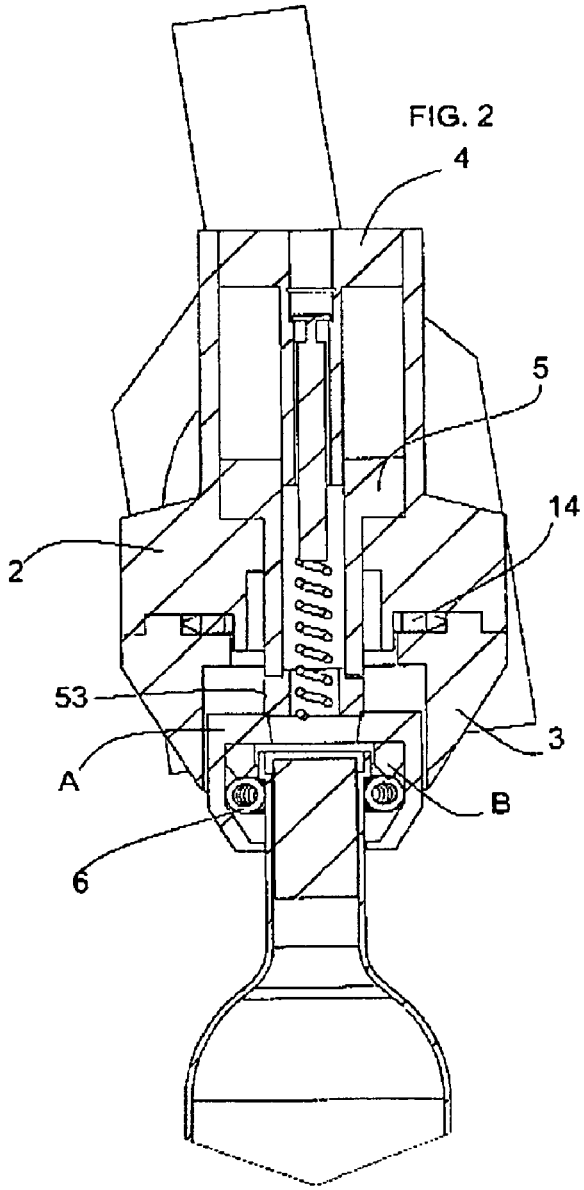
FIG. 2 is a cross-section of the corkscrew of the invention facing the side of the corkscrew.

The central body 2 has two plane and parallel surfaces 2*a* and a pin 2*b* to allow its coupling with levers 7 and 8, which are shown in FIG. 2. The levers 7 and 8 make it possible to extract the cork as explained below.

The central body 2 contains therein several two concentric barrels 4 and 5. Barrel 4 into the central body 2 and into the barrel 5.

Each barrel 4 and 5 is equipped with a pair of tooth pins 41 and 51 that respectively move in corresponding openings 21 located on the central body 2 (and precisely along the abutting surfaces of levers 7 and 8) in order to make the barrels 4 and 5 move in a rectilinear stroke parallel to the axis of the cork to be extracted.

It can be observed that every opening 21 drives both pin 41 and pin 51.

Barrel 4 is equipped, in its lower end, with an idle worm 43 (in the art, it designates the helical bit that will have to be inserted into the cork) while barrel 5 is equipped in its lower part with a helical (fixed) bush 53 which said worm 43 engages, thereby allowing their rotation-translation.

In the lower part of the central body and base 3, a garter spring arrangement 6 is located for anchoring the corkscrew to the bottle. The garter spring arrangement is composed of two parts, designated in this example by A and B. Part B is fixed to the central body 2 and is inserted in the corresponding part A that does not slide vertically with respect to this latter one.

Initially when the screwing action is performed by inserting the bottle to be opened into the corkscrew 1, part A remains upwards with the spring compressed around the bottle neck in a blocking position.

With reference to FIG. 2, one of the two levers 7 and 8 are shown precisely with its internal part that contacts with the corresponding surface 2*a* of the body 2. Two cam grooves are provided on the lever, and are called herein below shaped outlines and designated by references 11 and 12, each one of which respectively contacts pin 41 and pin 51, after said pins have been inserted in their corresponding openings 21 as described before.

Outline 11 is different from outline 12 that is used for extracting the cork in order to allow, as described below, screwing and unscrewing the cork easily and without difficulty.

From FIG. 2, it can be observed that every lever has a series of teeth 13 that will mesh with corresponding toothed wheel 14 which is placed inside the corkscrew 1, between the central body 2 and the base 3 once the lever is centered through its hole 15 around pin 2*b*.

Figure 5:
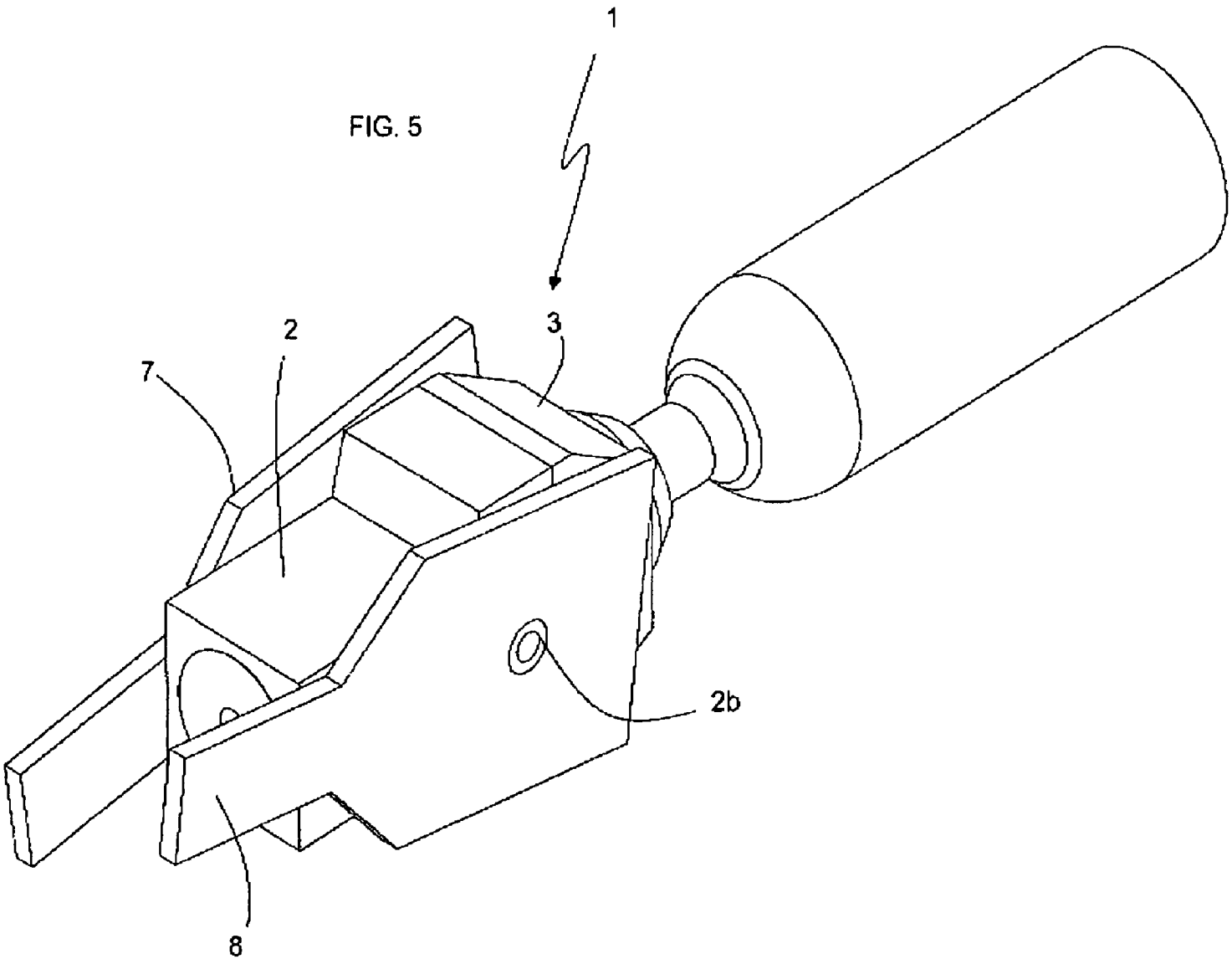
FIG. 5 is a perspective view of the cork screw of the invention.
Figure 6:
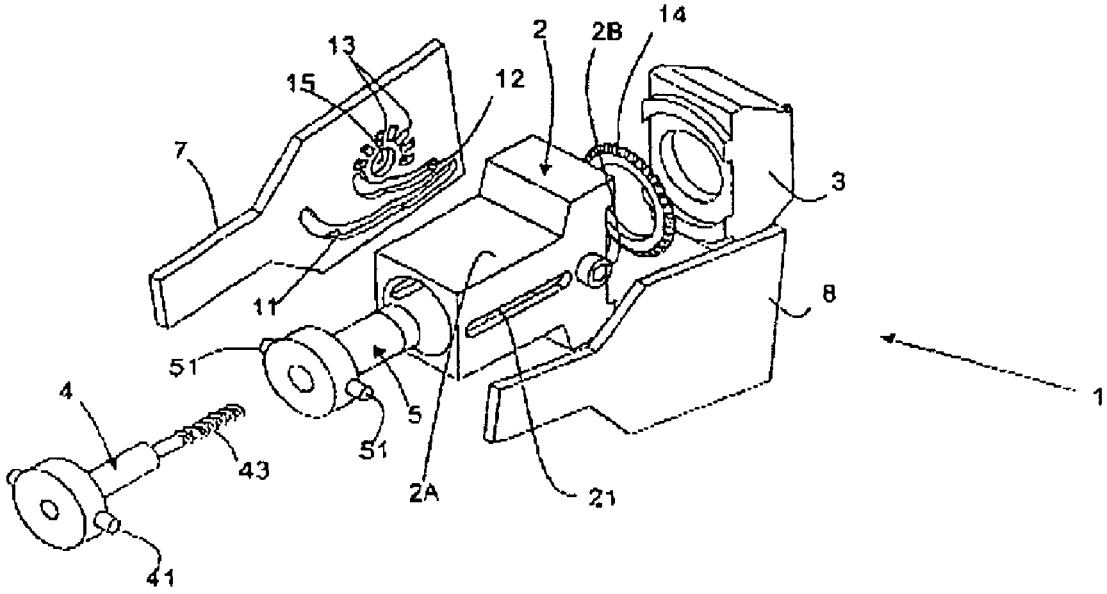
FIG. 6 is an exploded perspective view of the corkscrew of the invention.

FIGS. 3, 4 and 5, the functional diagram of the lever corkscrew 1 with its main internal components.

By placing the corkscrew 1 with lifted levers onto the bottle to be uncorked. (FIG. 3) and by rotating levers 7 and 8, the anchoring of the bottle with the garter spring 6 occurs first (by lifting part A with respect to part 73) and afterwards, by continued rotation, the idle worm 43 is screwed into the cork (FIG. 4) and afterwards is extracted by means of the complete stroke of pins 41 and 51.

Thereafter the two levers are completely lowered and both barrels are completely lifted (FIG. 5).

By returning the two levers 7 and 8 towards their initial position (namely by performing a counter-rotation), both barrels 4 and 5 simultaneously descend down to their bottom center (as shown in FIG. 4) and afterwards, by continued counter-rotation, only barrel 4 is lifted up while barrel 5 remains, due to the effect of the arrangement of outline 12, in its bottom center. It follows that the idle worm starts to be unscrewed from the cork due to the rotation performed, by the bush 53 that is secured to the barrel 5 (within which the worm is passed).

It is clear that, before performing the above counter-rotation, it is necessary to remove the uncorked bottle from the corkscrew which is, released by the garter spring 6.

Corkscrew 1 is now again in its initial position ready for reuse.

During the above-described steps, the movements of the levers are synchronized by the assembly both of toothed wheel 14 and of the teeth 13 that contact the levers as described previously.

The sequence to be performed for extracting and ejecting a cork from a bottle is summarised by steps:

Placing the bottle neck inside the lower opening provided in part A of the helical-spring closure arrangement, the bottle is placed against the bush 53 and the levers 7 and 8 are vertically placed the garter spring 6 during the descent of worm 43 caused by the rotation pressure to which levers 7 and B are subjected;

The barrel 4 descends into body 2 and the idle worm 43 is completely screwed into the cork; the barrel 4 reaches the lower center as shown by the corresponding outline 11 (FIG. 4);

Extracting the cork due to the continued rotation previously performed by the levers 7 and 8 and due to the simultaneous rise of the barrels 4 and 5 imposed by the corresponding outlines 11 and 12, the barrels 4 and 5 keep the same distance so that the worm 43 does not rotate in the bush 53 and therefore the cork follows the stroke of worm 43 without being unscrewed. When the levers are completely lowered and the barrels are in their maximum position inside the central body 2 of the corkscrew 1 (FIG. 5), the uncorked bottle is moved away (the helical spring 6 is not kept against the bottle neck by parts A and El). Counter-rotating the levers 7 and 8 brings back the corkscrew 1 to its initial configuration with both barrels firstly going back to their lower center (FIG. 4) and following a further counter-rotation, the barrel 4 rises again till it gets to its initial configuration while barrel 5, remaining in position, causes the idle worm 43 to be unscrewed from the cork.

The invention claimed is:

1. Corkscrew (1) for caps made of cork comprising a central body (2) and a base (3) joined thereto; the central body (2) having two plane and parallel surfaces (2*a*) each one of which has a pin (2*b*) that allows a coupling with a first lever (7) and a second lever (8) wherein:

each of said levers (7, 8) have corresponding grooves (11, 12), each of said grooves being in contact respectively with a first pin (41) and a second pin (51) that project respectively from a first concentric barrel (4) and a second concentric barrel (5) inserted in said central body (2);

said first concentric barrel (4) having a worm (43) while said second concentric barrel(5) has a bush (53)inside of which said worm (43) is engaged;

said first pin (41) and said second pin (51) being coupled respectively with said grooves by passing through a rectilinear opening (21) provided in the central body (2) so that said first concentric barrel(4) and said second concentric barrel (5) perform a rectilinear stroke along an axis of a cork to be extracted wherein the rectilinear opening (21) drives both said first pin (41) and said second pin (51).

2. Corkscrew (1) according to claim 1, characterised in that the levers (7, 8) are symmetrically connected to the central body (2) and rotate about the axis of the pin (2*b*) that projects from the surface (2*a*).

3. Corkscrew (1) according to claim 1, characterised in that said levers (7, 8) have a series of teeth (13) that mesh with a corresponding perpendicular toothed wheel (14) placed inside the corkscrew (1), between the central body (2) and the base (3) in order to mutually affect the movement of said levers.

4. Process for extracting a cork from a bottle using the corkscrew of claim 1 wherein said process also ejects said cork through the following steps:

placing a neck of a bottle in a lower opening of a garter spring arrangement (6) on said central body (2) and precisely placing said bottle against said bush (53);

tightening said garter spring on the bottle neck while rotating the levers (7 and 8) to cause said worm(43) to descend, descending the first concentric barrel and completely screwing the worm (43) into a cork while the first concentric barrel reaches a lower center due to a corresponding groove (11);

extracting the cork due to the continuation of the rotation previously performed by the levers (7,8) which causes the simultaneous rise of first concentric barrel (4) and second concentric barrel (5) by engagement with said corresponding grooves (11,12);

moving away the uncorked bottle;

counter rotating the levers (7,8) in order to bring the corkscrew (1) to an initial configuration where both of said first concentric barrel (4) and second concentric barrel (5) go back to a lower center and following a further counter-rotation, said first concentric barrel (4) rises again until it gets to a initial configuration while said second concentric barrel (5) remains in position and cause the idle worm (43) to be unscrewed.

* * * * *